US005178219A

United States Patent [19]

Striech et al.

[11] Patent Number: 5,178,219

[45] Date of Patent: Jan. 12, 1993

[54] METHOD AND APPARATUS FOR PERFORMING A BLOCK SQUEEZE CEMENTING JOB

[75] Inventors: Steven G. Striech; Kenneth D. Caskey, both of Duncan, Okla.

[73] Assignee: Halliburton Company, Duncan, Okla.

[21] Appl. No.: 722,068

[22] Filed: Jun. 27, 1991

[51] Int. Cl.[5] ..... E21B 23/06; E21B 33/124; E21B 33/138

[52] U.S. Cl. ..... 166/289; 166/127; 166/133; 166/138; 166/191; 166/387

[58] Field of Search ..... 166/387, 119, 126, 127, 166/191, 183, 290, 138, 133, 123, 289

[56] References Cited

U.S. PATENT DOCUMENTS

| | | | |
|---|---|---|---|
| 859,304 | 7/1907 | Larken et al. | 166/191 X |
| 1,248,882 | 12/1917 | Mack | 166/191 X |
| 1,956,694 | 5/1934 | Parrish | 166/191 X |
| 2,618,340 | 11/1952 | Lynd | 166/191 X |
| 3,012,611 | 12/1961 | Haines | 166/191 X |
| 3,119,450 | 1/1964 | Evans | 166/119 |
| 3,163,225 | 12/1964 | Perkins | 166/123 |
| 3,189,096 | 6/1965 | Phenix | 166/133 |
| 3,339,637 | 9/1967 | Holden | 166/128 |
| 3,409,085 | 11/1968 | Oliver | 166/134 |
| 3,584,684 | 6/1971 | Anderson et al. | 166/129 |
| 3,695,352 | 10/1972 | McGill | 166/127 X |
| 4,151,875 | 5/1979 | Sullaway | 166/126 |
| 4,545,431 | 10/1985 | Fore | 166/183 |
| 4,567,944 | 2/1986 | Zunkel et al. | 166/120 |
| 4,569,396 | 2/1986 | Brisco | 166/305.1 |
| 4,590,995 | 5/1986 | Evans | 166/127 |
| 4,627,491 | 12/1966 | Zunkel | 166/126 |
| 4,928,762 | 5/1990 | Manke | 166/192 |

OTHER PUBLICATIONS

Halliburton Services Sales & Service Catalog No. 43, published in 1985, pp. 2561-2565; and 2409-2411.

Paper entitled Tool Combinations Part 4 (undated but admitted to be prior art).

*Primary Examiner*—Stephen J. Novosad

*Attorney, Agent, or Firm*—James R. Duzan; Neal R. Kennedy

[57] ABSTRACT

A method and apparatus for performing a block squeeze cementing job. The invention provides for perforating the wellbore above and below the desired well formation on a single wireline trip and setting a lower packer on a wireline above the lower perforations. A stinger is positioned in the lower packer, and secondary packer elements on an upper packer are set above the upper perforations. Cementing of the lower perforations is carried out through the lower packer. The secondary packer elements are unset, and the stinger is repositioned adjacent to the upper perforations. Primary packer elements on the upper packer are then set, and the cementing of the upper perforations is carried out through the upper packer and stinger. Setting of the secondary packer elements requires only vertical movement of the tubing string and no rotation. Both cementing steps are carried out on a single tubing trip. The upper packer is retrievable, and the lower packer is of a drillable type. Hydraulic slips may be provided on the upper packer to prevent movement thereof during either cementing operation.

19 Claims, 6 Drawing Sheets

METHOD AND APPARATUS FOR PERFORMING A BLOCK SQUEEZE CEMENTING JOB

BACKGROUND OF THE INVENTION

1. Field Of The Invention

This invention relates to methods and apparatus for performing block squeeze cementing jobs on oil wells, and more particularly, to a packer apparatus and method of use which eliminates one wireline trip and one tubing trip.

2. Description Of The Prior Art

It is sometimes desirable in production of oil wells to place cement through perforations in the casing of the well both below and above the oil producing formation or zone. This cementing is carried out to prevent water and/or gas from migrating to the wellbore along with the oil. The intent is to leave the water and gas in the formations adjacent to the oil producing zone so that the water and gas will drive the oil to the wellbore, thereby increasing recovery of oil.

Current procedures for accomplishing this comprise making a lower set of perforations and then squeezing cement into the zone below the oil producing zone. Typically used is a drillable squeeze packer, such as Halliburton's EZ Drill® SV Squeeze Packer, which is similar to that illustrated in U. S Pat. No. 4,151,875 to Sullaway, assigned to the assignee of the present invention. The packer is set above the lower set of perforations, and cement is squeezed into this lower perforated zone.

In this prior art procedure, a set of upper perforations is then made above the oil producing zone, and cement is squeezed into the formation above the oil producing zone using a retrievable packer, such as the Halliburton RTTS® Retrievable Packer.

This prior art process works well. However, making the upper and lower perforations and setting of the drillable packer are conducted on a wireline. The lower perforations are made first, and the drillable packer is set. Then, the wireline company personnel must remain at the location until the first cementing job is done before they can make the second set of perforations. The result is an additional wireline trip with increased expense in the entire block squeeze cementing job. Therefore, there is a need for a cementing job which can reduce the number of trips into the wellbore, and particularly one which does not require wireline company personnel waiting on other operations.

The present invention meets this need by providing an apparatus and method for block squeeze cementing which allows both sets of perforations to be made during one wireline trip into the well. The drillable packer is then set, and the wireline company personnel can leave. The present invention also eliminates one trip in the well with a well tubing string by permitting both squeeze cementing jobs to be done on the same tubing trip.

SUMMARY OF THE INVENTION

The apparatus and methods of the present invention are used for performing a block squeeze cementing job in a wellbore adjacent to an oil producing well formation. The invention allows the block squeeze cementing job to be carried out with only two wireline trips and a single tubing trip.

A preferred method of block squeeze cementing of the present invention comprises the steps of perforating the wellbore above and below the well formation on a single wireline trip, setting a lower packer on a wireline above the lower perforations formed by the step of perforating, positioning a stinger in the lower packer, setting an upper packer above the upper perforations formed by the step of perforating, cementing the lower perforations through the lower packer, unsetting the upper packer, repositioning the stinger adjacent to the upper perforations, setting the upper packer above the upper perforations, and cementing the upper perforations through the upper packer and stinger. The first mentioned step of setting the upper packer preferably comprises setting secondary packer elements on the upper packer, and the last mentioned step of setting the upper packer comprises setting primary packer elements on the upper packer.

Setting the secondary packer elements preferably requires only vertical movement of the tubing string and no rotation thereof. The method may further comprise the step of locking the upper packer against vertical movement while cementing the lower perforations.

Preferably, the stinger opens a valve in the lower packer when inserted therein. Both steps of setting the upper packer and the steps of cementing the lower and upper perforations are carried out on a single tubing trip.

The apparatus of the present invention may be said to comprise an upper packer portion connectable to a tubing string, a stinger extending downwardly from the upper packer portion and in communication therewith, and a lower packer portion adapted for receiving the stinger therein.

The lower packer portion preferably comprises a valve therein, and the stinger is adapted for opening the valve in the lower packer portion. In one embodiment, the valve is a sliding valve having a collet extending therefrom, and the stinger is adapted for engaging the collet for opening and closing the valve. In another embodiment, the valve is a poppet type valve, and the stinger is adapted for pivoting the valve to an open position when inserted into the lower packer portion.

The upper packer portion may be described as comprising case means for connecting to the tubing string, mandrel means disposed in the case means for extending downwardly therefrom, primary packing means on the mandrel means for sealingly engaging the wellbore when in a set position, and secondary packing means on the mandrel means for sealingly engaging the wellbore when in a set position The secondary packing means is preferably set with only vertical movement of the tubing string, and the secondary packing means requires less vertical movement of the tubing string for setting than does the primary packing means. The secondary packing means is preferably disposed below the primary packing means. The primary and secondary packing means are individually setable on a single trip of the tubing string into the wellbore.

The secondary packing means may be characterized by one or more secondary packer elements disposed around the mandrel means, and the primary packing means may be characterized by one or more primary packer elements disposed around the mandrel means.

The upper packer portion may further comprise hydraulic slips which may be actuated by pressure below the secondary packer elements when the secondary packer elements are set.

The upper packer portion preferably defines a bypass passageway therein for equalizing pressure above and below the secondary packer elements. When pressure below the secondary packer elements is greater than the pressure thereabove, the hydraulic slips are set by pressure communicated through the bypass passageway.

An important object of the present invention is to provide an apparatus and method for block squeeze cementing which minimizes the number of wireline and tubing trips required.

Another object of the invention is to provide a method of block squeeze cementing in which perforations above and below the well formation may be made on a single wireline trip.

A further object of the invention is to provide a block squeeze cementing method in which cementing both the lower and upper perforations are carried out on a single tubing trip into the wellbore.

Still another object is to prevent cement migration through the producing zone and up to the upper perforations.

An additional object of the present invention is to provide a packer having primary and secondary packer elements which are individually setable for use in cementing the upper and lower perforations, respectively, in a block squeeze cementing job.

Additional objects and advantages of the invention will become apparent as the following detailed description of the preferred embodiments is read in conjunction with the drawings which illustrate such preferred embodiments.

DESCRIPTION OF THE PREFERRED EMBODIMENTS

Figure 1:
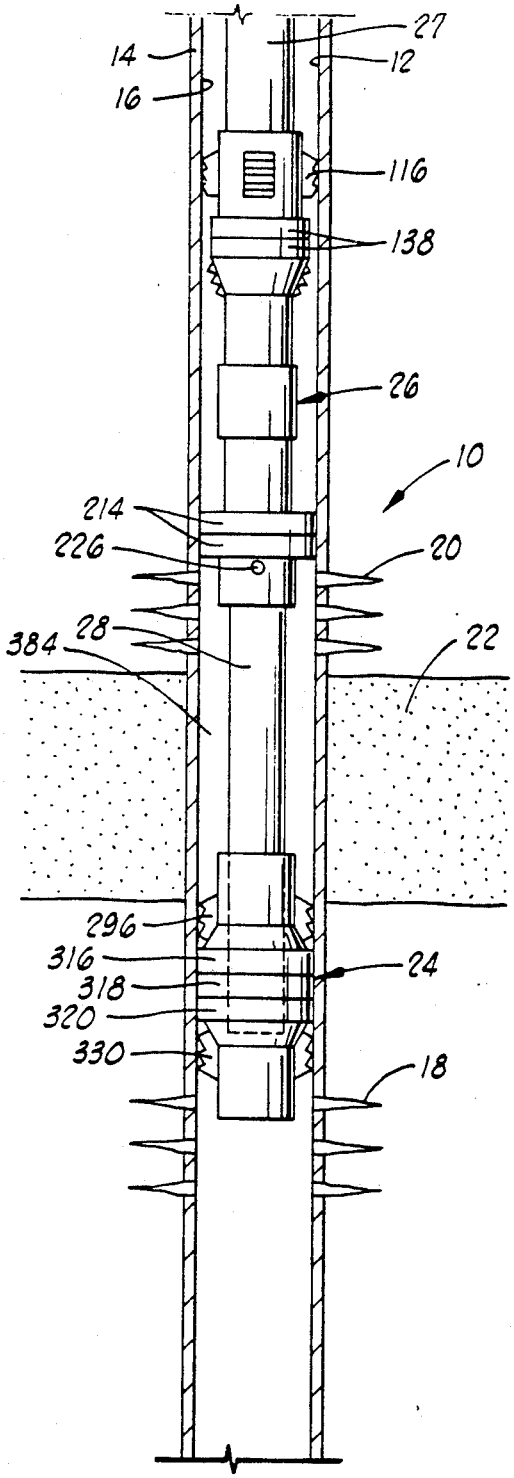
FIG. 1 is a schematic of the block squeeze cementing apparatus of the present invention shown in position for squeeze cementing lower perforations
Figure 2:
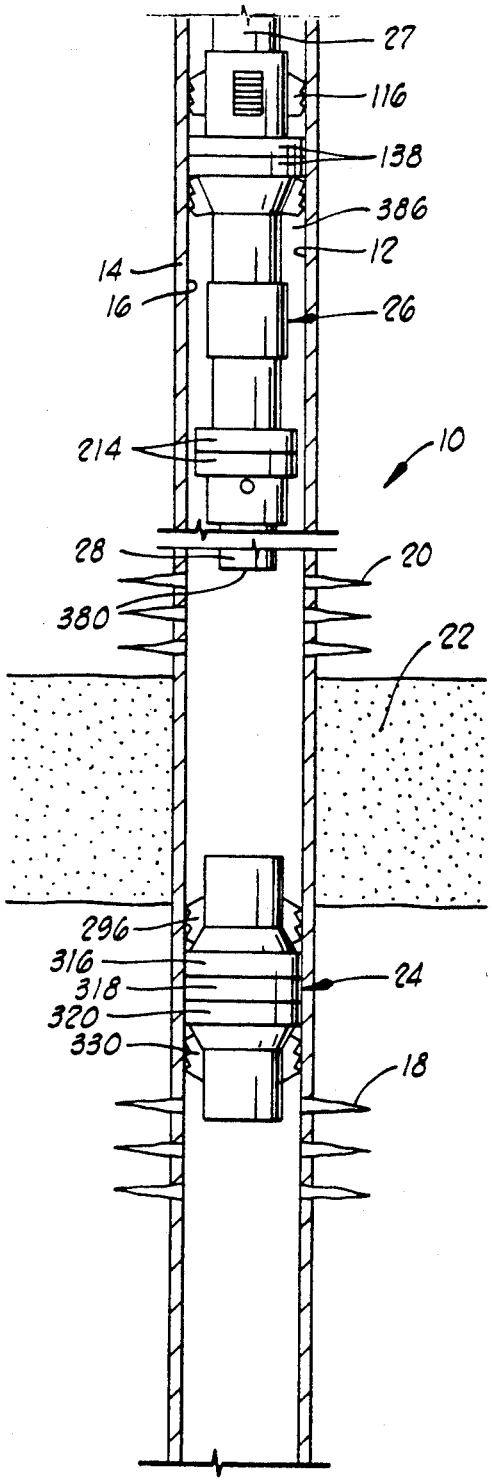
FIG. 2 illustrates the apparatus in position for squeeze cementing upper perforations.

Referring now to the drawings, and more particularly to FIGS. 1 and 2, the packer apparatus for block squeeze cementing of the present invention is generally designated by the numeral 10 and shown in position in a wellbore 12. Wellbore 12 has a casing 14 therein which defines a casing bore 16. As will be further discussed herein, FIGS. 1 and 2 illustrate apparatus 10 in position for squeeze cementing lower perforations 18 and upper perforations 20, respectively, through casing 14 in wellbore 12. Lower and upper perforations 18 and 20 are on opposite sides of an oil producing formation or zone 22.

Packer apparatus 10 comprises a lower packer portion 24 and an upper packer portion 26 Upper packer portion 26 is attached to tubing string 27. A stinger 28 extends downwardly from upper packer portion 26 and is adapted for stinging into lower packer portion 24 as shown in FIG. 1. This operation will be discussed in more detail herein.

Lower packer portion 24 is preferably a drillable packer such as the Halliburton EZ Drill ® Packer similar to the packer disclosed in U.S. Pat. No. 4,151,875 or the Halliburton DTTS ® Packer disclosed in U.S. Pat. No. 4,834,184, both assigned to the assignee of the present invention. Other drillable packers are also suitable. Upper packer portion 26 is preferably a retrievable packer.

Referring now to FIGS. 3A-3H, the details of packer apparatus 10 will be discussed. First, it is noted that upper packer portion 26 and stinger 28 define a central opening 29 therethrough.

Figure 3A:
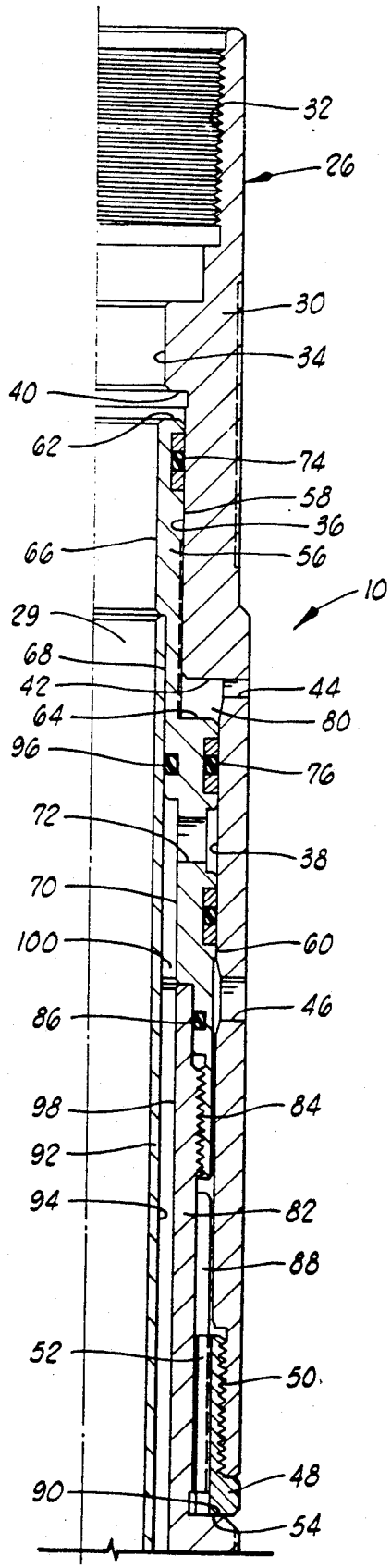
FIGS. 3A-3H show a longitudinal cross section of a preferred embodiment of the block squeeze cementing apparatus.

At the upper end of upper packer portion 26 is a case 30 shown in FIG. 3A. Case 30 has an internally threaded surface 32 adapted for engagement with the tubing string. Thus, case 30 forms a portion of a case means for connecting to tubing string 27. Case 30 defines a first bore 34, a second bore 36 and a third bore 38 therein. A downwardly facing annular shoulder 40 extends between first bore 34 and second bore 36, and a downwardly facing annular shoulder 42 extends between second bore 36 and third bore 38.

Case 30 defines a transverse pressure equalizing port 44 therethrough adjacent to the upper end of third bore 38. A case bypass port 46 is also defined in case 30, and the case bypass port is in communication with third bore 38.

At the lower end of case 30, a spline ring 48 is connected to the case at threaded connection 38. Spline ring 48 has an internal spline 52 defined therein. Spline ring 48 has a lower end 54.

Slidably disposed in case 30 is a bypass mandrel 56. Bypass mandrel 56 has an upper, first outside diameter 58 and a lower, second outside diameter 60. It will be seen that first outside diameter 58 of bypass mandrel 56 is adapted for sliding engagement within second bore 36 of case 30, and second outside diameter 60 of the bypass mandrel is adapted for sliding engagement within third bore 38 in the case. Bypass mandrel 56 has an upper end 62 which generally faces shoulder 40 in case 30. An upwardly facing annular shoulder 64 extends between first outside diameter 58 and second outside diameter 60. Shoulder 64 generally faces shoulder 42 in case 30.

Bypass mandrel 56 defines a first bore 66, a second bore 68 and a third bore 70, which are progressively larger. A transverse mandrel bypass port 72 is defined through bypass mandrel 56. Bypass mandrel port 72 is in communication with third bore 70 in bypass mandrel 56 and third bore 38 in case 30.

A sealing means, such as seal 74, provides sealing engagement between bypass mandrel 56 and second bore 36 in case 30. Another sealing means, such as a pair of seals 76 and 78 provide sealing engagement between bypass mandrel 56 and third bore 38 in case 30. It will be seen that seals 76 and 78 are on opposite sides of mandrel bypass port 72. When in the initial position shown in FIG. 3A, seal 78 sealingly separates mandrel bypass port 72 from case bypass port 46.

Also when in the initial position shown in FIG. 3A, an annular volume 80 is defined between case 30 and bypass mandrel 56, and this annular volume is in communication with equalizing port 44. Seals 74 and 76 prevent further communication between equalizing port 44 and the interior of packer apparatus 10.

The lower end of bypass mandrel 56 is attached to a splined connector 82 at threaded connection 84. A sealing means, such as 0-ring 86, provides sealing engagement between bypass mandrel 56 and splined connector 82.

Connector 82 has an external spline 88 thereon which is engaged with internal spline 52 in spline ring 48. Those skilled in the art will thus see that relative rotation between case 30 and connector 82 is prevented, while relative longitudinal movement therebetween is allowed. Connector 82 has an upwardly facing annular shoulder 90 thereon which is initially adjacent to lower end 54 on spline ring 48, as seen in FIG. 3A.

The upper end of a central mandrel 92 has a first outside diameter 94 which is adapted for close relationship with second bore 68 in bypass mandrel 56. A sealing means, such as 0-ring 96, provides sealing engagement between central mandrel 92 and bypass mandrel 56. First outside diameter 94 on central mandrel 92 is spaced inwardly from third bore 70 in bypass mandrel 56 and bore 98 in connector 82. Thus, an annular passageway 100 is formed. As will be further discussed herein, passageway 100 is sometimes referred to as bypass passageway 100 and extends through most of the length of upper packer portion 26 of packer apparatus 10.

Figure 3B:
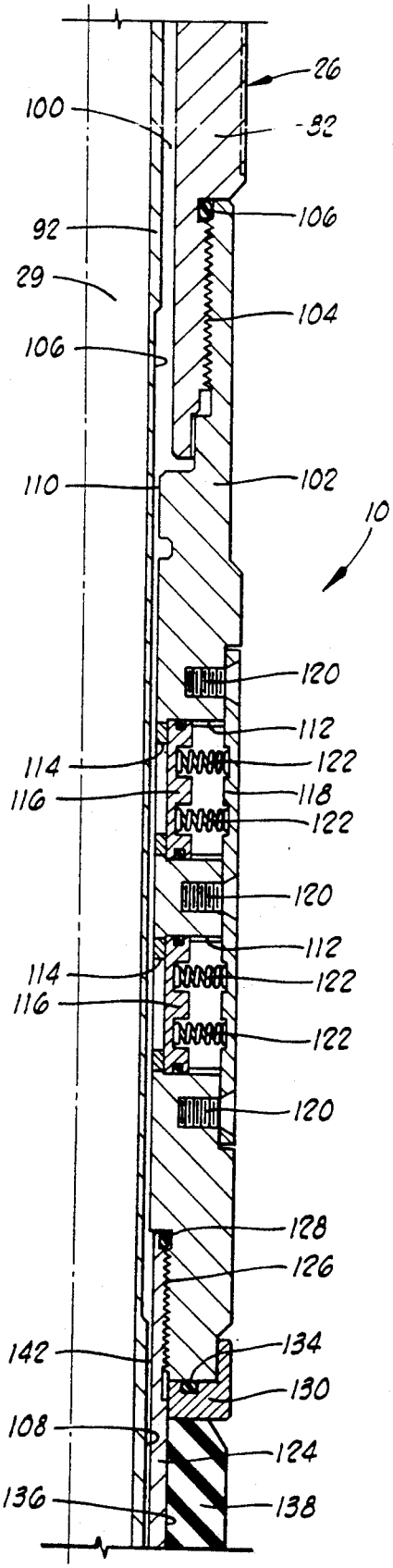

Referring now to FIG. 3B, the lower end of connector 82 is attached to hydraulic hold-down body 102 at threaded connection 104. A sealing means, such as an 0-ring 106, provides sealing engagement between connector 82 and body 102.

Central mandrel 92 has a second outside diameter 106 and a third outside diameter 108 thereon. Second outside diameter 106 is spaced inwardly from bore 110 in body 102 so that passageway 100 continues downwardly through body 102.

A plurality of transverse first openings 112 are defined in body 102, and corresponding second openings 114 provide communication between first openings 112 and passageway 100.

A hydraulic slip 116 is disposed in each first opening 112. A hold-down strap 118, attached to body 102 by a plurality of screws 120, retains hydraulic slips 116 in first openings 112. A biasing means, such as a plurality of springs 122, biases hydraulic slips 116 radially inwardly.

The lower end of body 102 is connected to a primary packer mandrel 124 at threaded connection 126. A sealing means, such as 0-ring 128, provides sealing engagement therebetween.

An upper primary packer shoe 130 is disposed adjacent to the lowermost end of body 102. A sealing means, such as 0-ring 134, provides sealing engagement between shoe 130 and body 102.

Figure 3C:
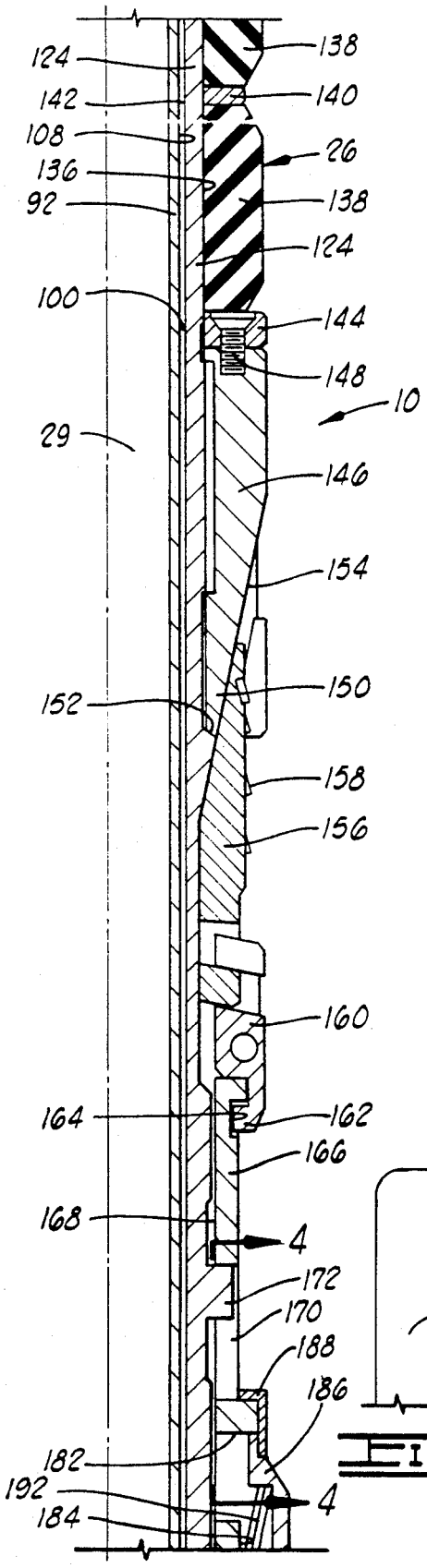

Primary packer mandrel 124 has a first outside diameter 136 thereon Referring to FIGS. 3B and 3C, a pair of elastomeric primary packer elements 138 are disposed around first outside diameter 136 on primary packer mandrel 124. A spacer ring 140 is preferably disposed between packer elements 138. Thus, a primary packing means for upper packer portion 26 is provided Although this primary packing means is illustrated by a pair of packer elements 138 separated by spacer ring 140, the exact number and layout of packer elements may vary. The invention is not intended to be limited to the specific configuration illustrated.

Primary packer mandrel 124 has a bore 142 therein which is spaced outwardly from third outside diameter 108 of central mandrel 92 Thus, bypass passageway 100 extends downwardly through primary packer mandrel 124. Below primary packer elements 138 is a lower primary packer shoe 144. Shoe 144 is attached to a slip wedge 146 by a fastening means, such as screw 148.

A lower end 150 of slip wedge 146 engages a shoulder 152 on primary packer mandrel 124 so that downward movement of slip wedge 146 with respect to the primary packer mandrel is prevented.

Slip wedge 146 has a tapered surface 154 thereon which is engaged by a plurality of slips 156. Each slip has a plurality of teeth 158 formed on the outer surface thereof which are adapted for grippingly engaging wellbore 12 in casing 14. Slips 156 are loosely retained in place by a slip collar 160.

Slip collar 160 has an inwardly directed flange 162 which engages a groove 164 in the upper end of a drag block sleeve 166.

Figure 4:
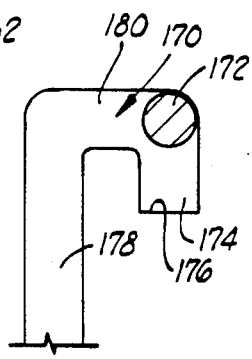
FIG. 4 is a view of a J-slot taken along lines 4—4 in FIG. 3C.

Drag block sleeve 166 has a bore 168 thereon through which a portion of primary packer mandrel 124 extends. Referring also to FIG. 4, a J-slot 170 is defined in bore 168 of drag block sleeve 166. A lug 172 extends radially outwardly from primary packer mandrel 124 into and engaging J-slot 170. J-slot 170 has a short leg 174 having a lower end 176 and is connected to a longer downwardly extending leg 178 by a transition portion 180.

Drag block sleeve 166 also defines a plurality of transverse drag block openings 182 therein. A cylindrical portion 184 of drag block sleeve 166 is aligned with openings 182 and faces radially outwardly. Disposed in each drag block opening 182 is a drag block 186. Each drag block 186 is retained in the corresponding drag block opening 182 by upper drag block retainer 188, seen in FIG. 3C, and lower drag block retainer 190, seen in FIG. 3D. A drag block spring 192 bears against cylindrical portion 184 of drag block sleeve 166 and biases the corresponding drag block 186 radially outwardly.

The lower end of primary packer mandrel 124 is attached to packer connector 194 at threaded connection 196. A sealing means, such as 0-ring 198, provides sealing engagement between upper packer mandrel 124 and packer connector 194. Packer connector 194 has a bore 200 therethrough which is spaced outwardly from third outside diameter 108 on central mandrel 92. Thus, bypass passageway 100 extends through packer connector 194.

The lower end of packer connector 194 is attached to secondary packer mandrel 202 at threaded connection 204. At the lower end of packer connector 194 is an upper secondary packer shoe 206. A sealing means, such as 0-ring 208, provides sealing engagement between packer connector 194 and upper secondary packer shoe 206.

Secondary packer mandrel 202 has a first outside diameter 210 and a second outside diameter 212 thereon. A pair of elastomeric secondary packer elements 214 are disposed around first outside diameter 210 on secondary packer mandrel 202. A spacer ring 216 is disposed between packer elements 214. Thus, a secondary packing means for upper packer portion 26 is provided Although this secondary packing means is illustrated by a pair of packer elements 214 and separated by a spacer ring 216, the exact number and layout of packer elements may vary. The invention is not intended to be limited to the specific configuration illustrated.

Primary packer mandrel 124 and secondary packer mandrel 202 characterize one embodiment of a mandrel means extending from the case means for receiving the primary and secondary packer means thereon.

Secondary packer mandrel 202 defines a first bore 218 and a second bore 220 therein. Second bore 220 is adapted for close relationship with third outside diameter 108 on central mandrel 92. As seen in FIG. 3E, a sealing means, such as 0-ring 222, provides sealing engagement between central mandrel 92 and secondary packer mandrel 202.

First bore 218 in secondary packer mandrel 202 is spaced outwardly from third outside diameter 108 on central mandrel 92. Thus, it will be seen that bypass passageway 100 extends downwardly through secondary packer mandrel 202 and terminates at the lower end of first bore 218. At the lower end of first bore 218, secondary packer mandrel 202 defines a transverse mandrel bypass port 224 which is thus in communication with bypass passageway 100. A shoe bypass port 226 defined in lower secondary packer shoe 228 is initially aligned with mandrel bypass port 224 and thus also is in communication with bypass passageway 100.

Figure 3D:
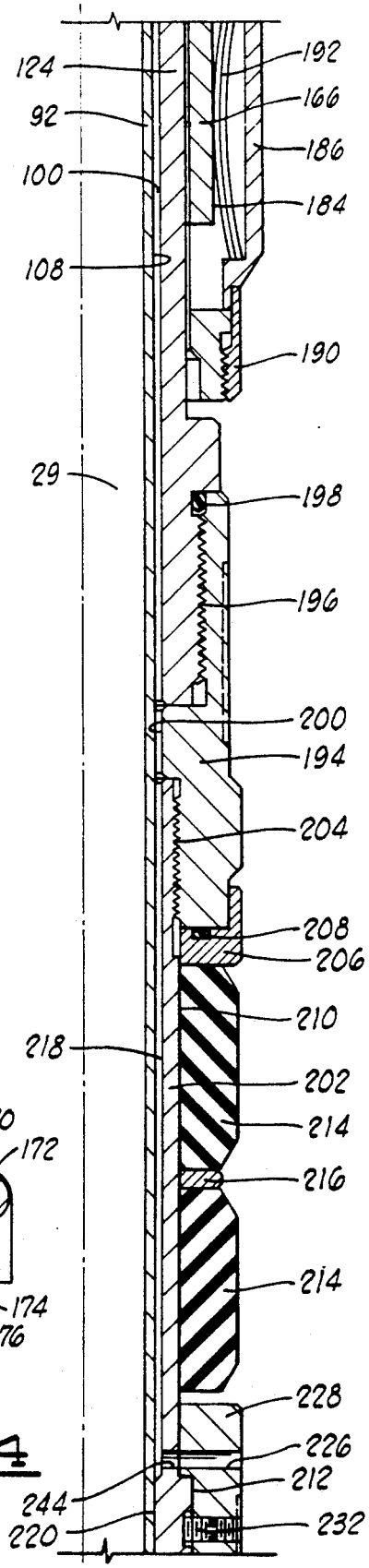
Figure 3E:
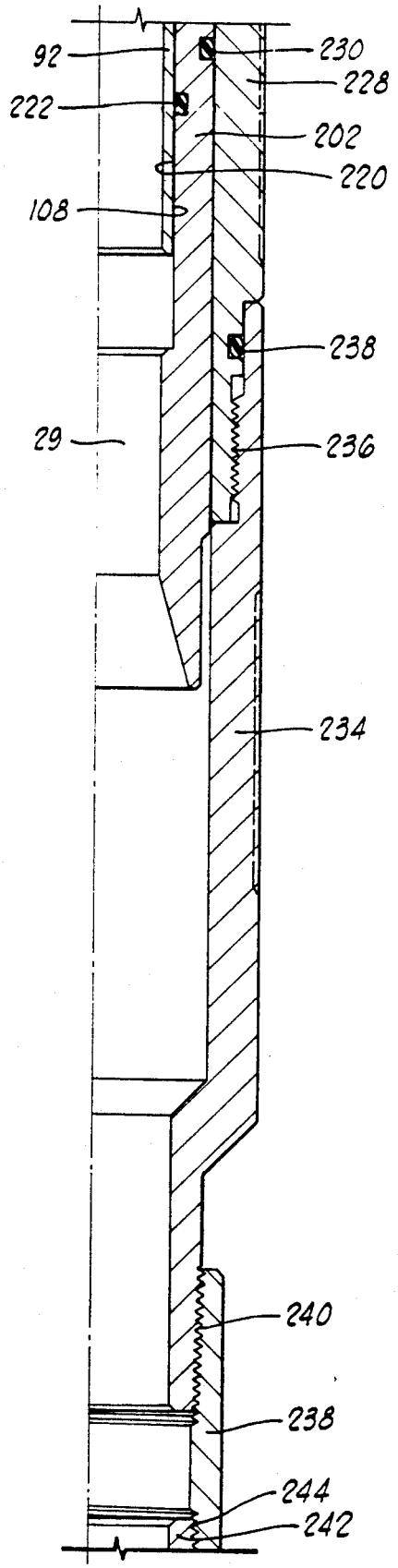

Lower secondary packer shoe 228 is disposed around secondary packer mandrel 202 as seen in FIGS. 3D and 3E. A sealing means, such as an 0-ring 230, provides sealing engagement between secondary packer mandrel 202 and lower secondary packer shoe 228.

Lower secondary packer shoe 228 is initially locked against movement with respect to secondary packer mandrel 202 by a shear pin 232.

Referring now to FIG. 3E, the lower end of lower secondary packer shoe 228 is attached to a packer adapter 234 at threaded connection 236. A sealing means, such as 0-ring 238, provides sealing engagement between lower secondary packer shoe 228 and packer adapter 234.

The lower end of packer adapter 234 is attached to a coupling 238 at threaded connection 240. Coupling 238 is attached at its lower end to a tubing joint 242 at threaded connection 244. See FIGS. 3E and 3F. As will be further discussed herein, tubing joint 242 has a variable, preselected length.

Figure 3F:
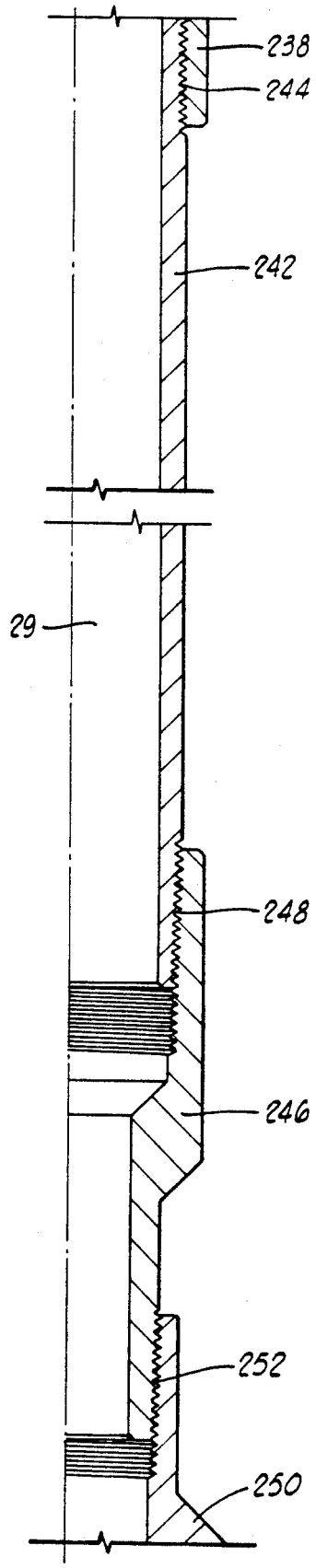

Still referring to FIG. 3F, the lower end of tubing joint 242 is connected to guide adapter 246 at threaded connection 248. The lower end of guide adapter 246 is attached to a star guide 250 at threaded connection 252.

Figure 3G:
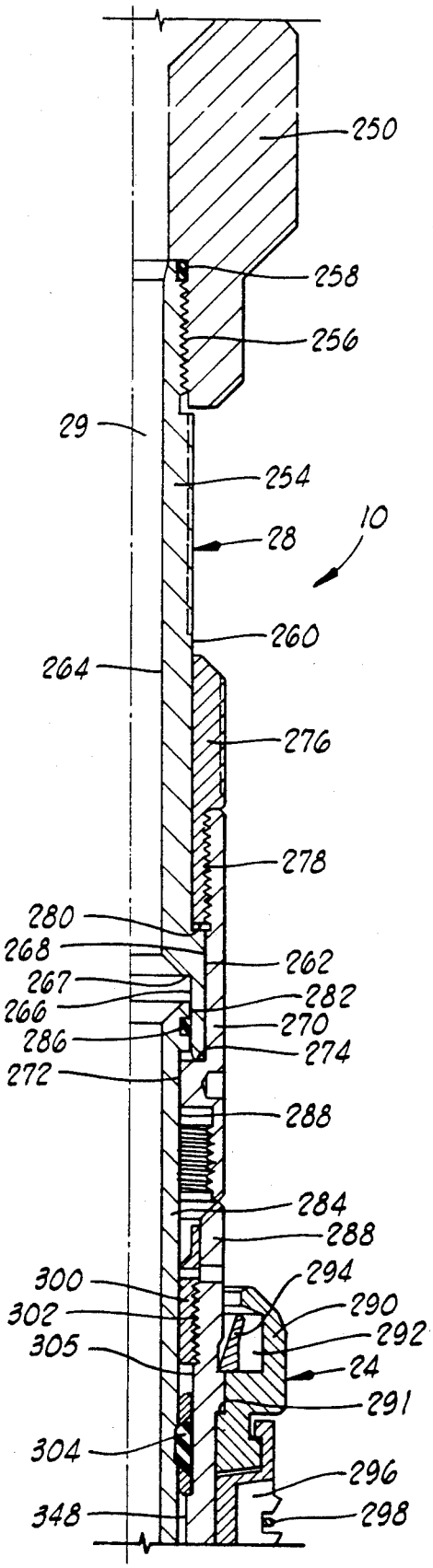

Referring now to FIG. 3G, the lower end of star guide 250 is attached to stinger sleeve 254 at threaded connection 256. A sealing means, such as 0-ring 258, provides sealing engagement between star guide 250 and stinger sleeve 254.

Stinger sleeve 254 is a portion of stinger 28. Stinger sleeve 254 has a first outside diameter 260 and a second outside diameter 262. Defined in stinger sleeve 254 are a first bore 264 and a slightly larger second bore 266. An annular shoulder 267 extends between first bore 264 and second bore 266.

Second outside diameter 262 of stinger sleeve 254 fits within first bore 268 of a stinger collar 270. Stinger collar 270 also defines a smaller second bore 272 therein, and an annular shoulder 274 extends between first bore 268 and second bore 272. A retainer 276 is attached to the upper end of stinger collar 270 at threaded connection 278. It will be seen that second outside diameter 262 of stinger sleeve 254 is thus retained between shoulder 274 in stinger collar 270 and lower end 280 of retainer 276.

A first outside diameter 282 of a stinger mandrel 284 is received in second bore 266 in stinger sleeve 254. A sealing means, such as an 0-ring 286, provides sealing engagement between stinger mandrel 284 and stinger sleeve 254. Stinger mandrel 284 also has a smaller second outside diameter 288. It will be seen that first outside diameter 282 of stinger mandrel 284 is retained between shoulder 267 in stinger sleeve 254 and shoulder 274 in stinger collar 270. It will also be seen that some relative longitudinal movement between stinger mandrel 284 and stinger sleeve 254 is possible.

Figure 3H:
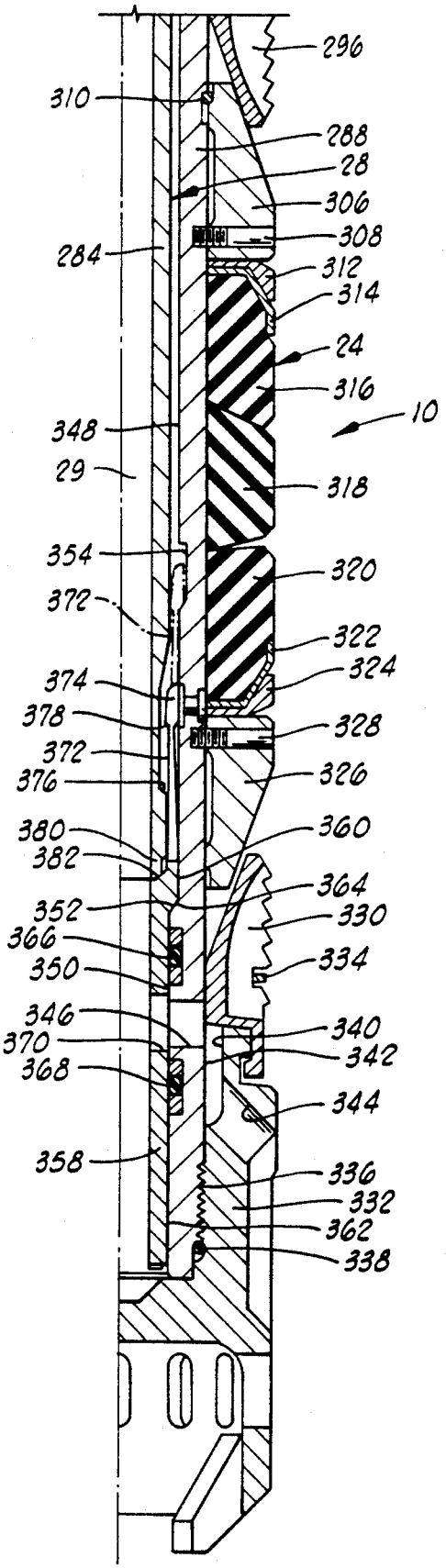

Stinger mandrel 284 of stinger 28 is adapted to extend downwardly into lower packer portion 24 of packer apparatus 10 as shown in FIGS. 1, 3G and 3H. The embodiment of lower packer portion 24 shown in FIGS. 3G and 3H is the Halliburton EZ Drill squeeze packer with pressure balance sliding valve, disclosed in Halliburton Services Sales & Service Catalog No. 43, page 2561. This packer is a variation of the EZ disposal packer shown in previously mentioned U.S. Pat. No. 4,151,875 to Sullaway, assigned to the assignee of the present invention.

Lower packer portion 24 has an inner mandrel 288, the upper end of which is adjacent to stinger collar 270 when in the position shown in FIGS. 3G and 3H. An upper slip support 290 is disposed around inner mandrel 288 and has a cavity 292 therein. A lock ring 294 is disposed in cavity 292 which holds upper slip support 290 in its initial position. Upper slip support 290 is loosely engaged by a plurality of upper slips 296 which are initially held in position by a breakable metal band 298.

A tension sleeve 300 is attached to the interior of inner mandrel 288 at threaded connection 302.

A sealing means, such as seal 304, provides sealing engagement between inner mandrel 288 and stinger mandrel 284.

Referring now to FIG. 3H, an upper slip wedge 306 is disposed below upper slips 296 and initially held in place on inner mandrel 288 by a shear pin 308.

The upper end of slip wedge 306 is centered about inner mandrel 288 by a snap ring 310 which prevents premature setting of upper slips 296 when lower packer portion 24 is inserted into the wellbore.

Below upper slip wedge 306 is an upper backup ring 312, below which is an upper packer shoe 314.

Elastomeric first, second and third packer elements 316, 318 and 320 are positioned on inner mandrel 288 below upper packer shoe 314. Upper packer shoe 314 bears on first packer element 316. A similar lower packer shoe 322 is below third packer element 320. A lower backup ring 324 helps support lower packer shoe 322.

A lower slip wedge 326 is slidably positioned on inner mandrel 288 below lower backup ring 324. Lower slip wedge 326 is initially held in place on inner mandrel 288 by a shear pin 328. Lower slip wedge 326 is substantially identical to upper slip wedge 306 in the preferred embodiment.

A plurality of lower slips 330 are positioned adjacent to lower slip wedge 326 and engage lower slip support 332. A breakable metal band 334 initially holds lower slips 330 in place.

Lower slip support 332 is attached to the lower end of inner mandrel 288 at threaded connection 336. A sealing means, such as 0-ring 338, provides sealing engagement between lower slip support 332 and inner mandrel 288.

Lower slip support 332 has a bore 340 therein which is spaced outwardly from outside diameter 342 of inner mandrel 288. Lower slip support 332 defines an angled port 344 therein which will be seen to be in communication with transverse port 346 in inner mandrel 288.

Inner mandrel 288 defines a second bore 348 therein and a smaller third bore 350 with a chamfered shoulder 352 therebetween. An annular groove 354 is formed in second bore 348 in inner mandrel 288 above shoulder 352.

A sliding valve 358 is disposed in inner mandrel 288. Valve 358 has a first outside diameter 360 adapted for sliding within second bore 348 in inner mandrel 288 and a second outside diameter 362 adapted for sliding within third bore 350 in the inner mandrel. A chamfered shoulder 364 extends between first outside diameter 360 and second outside diameter 362. When sliding valve 358 is in the lowermost, open position thereof, as shown in FIG. 3H, shoulder 364 generally engages shoulder 352 in inner mandrel 288.

A sealing means, such as a pair of seals 366 and 368, provides sealing engagement between inner mandrel 288 and third outside diameter 362 on sliding valve 358. Sliding valve 358 defines a transverse port 370 therethrough which is aligned with port 346 in inner mandrel 288 when sliding valve 358 is in the open position shown in FIG. 3H. Normally, sliding valve 358 is initially in a raised, closed position in which port 370 is above seal 366 and therefore is sealingly separated from port 346 in inner mandrel 288.

Extending upwardly on sliding valve 358 is a collet having a plurality of flexible, outward biased collet fingers 372. At the upper end of each collet finger is a lug 374. When in the open position shown in FIG. 3H, lugs 374 engage second bore 348 in inner mandrel 288, thereby deflecting collet fingers 372 radially inwardly.

At the lower end of stinger mandrel 284 is an upwardly facing annular shoulder 376. Shoulder 376 faces an inwardly directed shoulder 378 on each of lugs 374 at the ends of collet fingers 372. As will be further discussed herein, raising stinger 28, and thereby raising stinger mandrel 284, will cause shoulder 376 on the stinger mandrel to engage shoulders 378 on lugs 374 so that sliding valve 358 may be raised to its closed position. In this closed position, collet fingers 372 flex radially outwardly so that lug 374 extends into groove 354 in inner mandrel 288. This disengages shoulders 378 on lugs 374 from shoulder 376 on stinger mandrel 284. Thus, stinger mandrel 284 may be removed from lower packer portion 28 without further movement of sliding valve 358.

Lower end 380 of stinger mandrel 284 is adapted for engaging shoulder 382 in sliding valve 358 so that lowering stinger 28 and stinger mandrel 284 into lower packer portion 24 will move sliding valve 358 downwardly to its open position as shown in FIG. 3H.

OPERATION OF THE INVENTION

Referring again also to FIGS. 1 and 2, the setting and use of packer apparatus 10 will be discussed. First, both lower perforations 18 and upper perforations 20 are made during the first wireline trip into the well. Then, lower packer portion 24 is lowered into wellbore 12 on a second wireline trip and set in the position shown in FIG. 1 below formation 22 and above lower perforations 18.

The actual setting of lower packer portion 24 is in a manner known in the art. The setting tool (not shown) releases lock ring 294 and pulls inner mandrel 288 and lower slip support 332, upwardly with respect to upper slip support 290. During this process, lower slips 330 are wedged outwardly to engage casing bore 16. Shear pins 328 and 308 are sheared, and packer elements 316, 318 and 320 are squeezed so that they are deformed outwardly into sealing engagement with casing bore 16. Upper slips 296 are also wedged outwardly to gripping engage casing bore 16. During this setting operation, there is enough relative movement between inner mandrel 288 and upper slip support 290 so that snap ring 318 engages shoulder 291 in the upper slip support. Thus, lower packer portion 24 is held in its set position.

Once lower packer portion 24 is set, upper packer portion 26 and stinger 28 are lowered into wellbore 12 on tubing string 27. Lower end 380 of stinger mandrel 284 enters lower packer portion 24 and engages shoulder 382 in sliding valve 358. Downward movement of stinger 28 will force sliding valve 358 open in the manner previously described Weight is set down on tubing string 27 which causes packer connector 194 and secondary packer mandrel 202 to be moved downwardly with respect to lower secondary packer shoe 228, shearing shear pin 232. Secondary packer elements 214 are thus compressed into sealing engagement with casing bore 16. Relatively little vertical movement is required.

It will thus be seen that a sealed annulus 384 is formed between secondary packer elements 214 on upper packer portion 26 and packer elements 316, 318 and 320 on lower packer portion 24. Preferably, packer elements 214 are sealed above upper perforations 20. Sealed annulus 384 is a closed system.

Cement may be pumped through central opening 29 in apparatus 10 and out ports 370, 346 and 344 in lower packer portion 24 for squeeze cementing lower perforations 18. If the pressure in sealed annulus 384 is greater than the pressure above secondary packer elements 214, this pressure is communicated through shoe bypass port 226, mandrel bypass port 224 and bypass passageway 100 to hydraulic slips 116, forcing the hydraulic slips outwardly into gripping engagement with casing bore 116. Thus, upper packer portion 26 cannot be forced upwardly during the squeeze packing operation for lower perforations 18.

After the first squeeze cementing operation has been carried out, lifting on tubing string 27 will release secondary packer elements 218 from sealing engagement with casing bore 16. Lifting also realigns mandrel bypass port 224 with shoe bypass port 226. This places bypass passageway 100 in communication with the well annulus 384 below secondary packer elements 214, thus insuring that the pressure above and below the secondary packer elements is equalized.

Upper packer portion 26 and stinger 28 are then preferably raised by lifting tubing string 27 until lower end 380 of the stinger is positioned adjacent to the top of upper perforations 20, as seen in FIG. 2. As stinger mandrel 284 is moved out of lower packer portion 24, shoulder 376 on the stinger mandrel engages shoulder 378 on lugs 374 at the end of collet fingers 372. Lifting on stinger 28 and thus stinger mandrel 284 thus causes sliding valve 358 to be moved to its closed position in which lugs 374 are aligned with recess 354 in inner mandrel 288. Collet fingers 372 flex outwardly so that lugs 374 move into recess 354. As previously mentioned, this disengages shoulder 378 on lugs 374 from shoulder 376 on stinger mandrel 284, after which stinger mandrel 284 may be removed from lower packer portion 24.

After lower end 380 of stinger 28 is positioned as desired adjacent to upper perforations 20, upper packer portion 26 is set so that primary packer elements 138 are in sealing engagement with casing bore 16. This is accomplished by lifting on tubing string 27 and rotating to the right. Lug 172 is moved to the top of short leg 174 in J-slot 170, and the rotation moves the lug 172 through transition portion 180 until it is aligned with long leg 178 of J-slot 170. Drag blocks 186 prevent drag block sleeve 166 from rotating. Setting down weight then allows lugs 172 to move downwardly through long leg 178. As this occurs, slips 156 are pivoted outwardly into gripping engagement with casing bore 16. Primary packer elements 138 are squeezed into sealing engagement with casing bore 16.

Any pressure in the well annulus 386 below primary packer elements 138 on upper packer portion 26 is applied to hydraulic slips 116 through mandrel bypass port 224, shoe bypass port 226, and bypass passageway 100 so that the hydraulic slips are grippingly engaged with casing bore 16. This prevents primary packer portion 26 from being pumped upwardly in casing 14 during cementing.

Upper perforations 20 may then be squeeze cemented in the normal manner by pumping cement through central opening 29. After this is accomplished, upper packer portion 26, which is a retrievable packer, is unset by lifting on tubing string 27. Any excess cement is reverse circulated out of the hole. The retrievable packer is then pulled out of the wellbore. When desired, lower packer portion 24 is drilled out of the wellbore.

Thus, the entire block squeeze cementing job is carried out with only two wireline trips and one tubing trip.

ALTERNATE EMBODIMENT

Figure 5A:
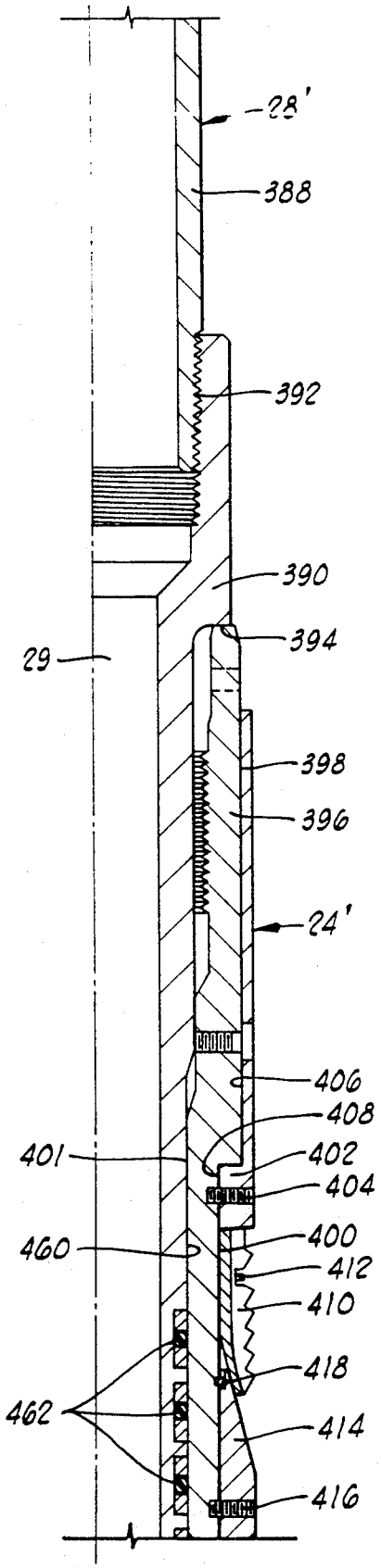
FIGS. 5A and 5B illustrate the lower end of an alternate embodiment of the apparatus.
Figure 5B:
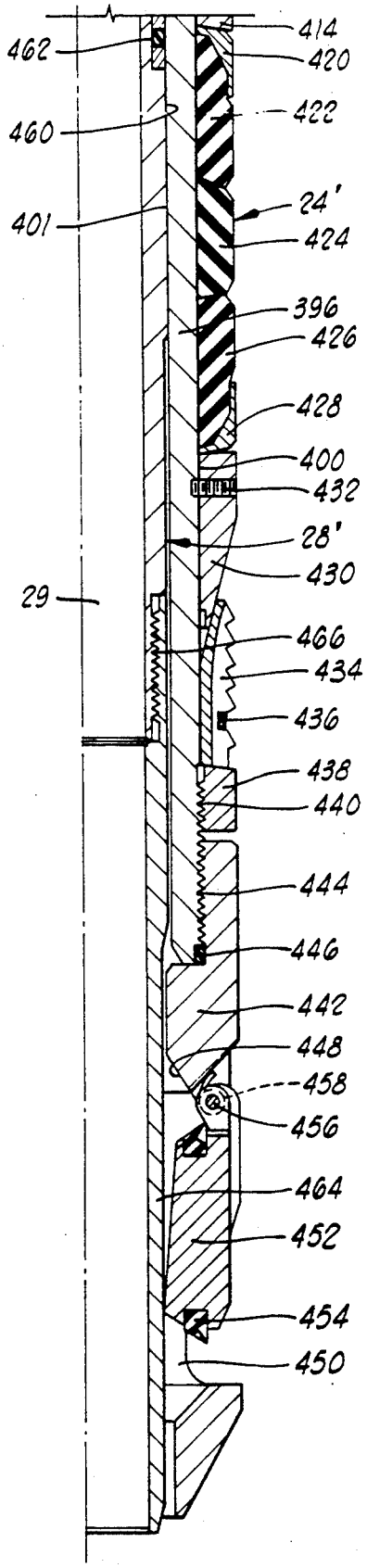

Referring now to FIGS. 5A and 5B, an alternate embodiment of the lower packer portion of apparatus 10 is shown and generally designated by the numeral 24'. In this embodiment, the stinger is also slightly different and is generally referred to by the numeral 28'.

Stinger 28' is similar to stinger 28, but has a stinger tube 388 therein which is attached to a stinger sleeve 390 at threaded connection 392. Stinger sleeve 390 has a downwardly facing shoulder 394 thereon.

Stinger 28' is adapted for insertion in lower packer portion 24'. Lower packer portion 24' comprises an inner mandrel 396 having a first outside diameter 398 and a second outside diameter 400. Inner mandrel 396 also defines a bore 401 therein.

An upper slip support 402 is slidably disposed on inner mandrel 398 and initially retained by a shear pin 404. Upper slip support 402 has a first bore 406 therein adapted for sliding engagement with first outside diameter 398 of inner mandrel 396 and a second bore 408 adapted for sliding engagement with second outside diameter 402 on the inner mandrel.

A plurality of upper slips 410 are disposed on second outside diameter 400 of inner mandrel 396 below upper slip support 402. Upper slips 410 are initially held in place by a breakable metal band 412.

Upper slips 410 are disposed above and engage an upper slip wedge 414 which is initially held in place on second outside diameter 400 of inner mandrel 396 by a shear pin 416. A snap ring 418 is positioned adjacent to the upper end of upper slip wedge 414.

Referring now to FIG. 5B, below upper slip wedge 414 is an upper packer shoe 420. Upper packer shoe 420 engages a first packer element 422. Below first packer element 422 is a second packer element 424 and a third packer element 426. Third packer element 426 is engaged by a lower packer shoe 428.

Below lower packer shoe 428 is a lower slip wedge 430 initially held in position on second outside diameter 400 of inner mandrel 396 by a shear pin 432. Below lower slip wedge 430 are a plurality of lower slips 434 which are initially held in position around second outside diameter 400 of inner mandrel 396 by a breakable metal band 436.

Lower slips 434 are immediately above a lower slip support 438 which is attached to inner mandrel 396 at threaded connection 440.

The lower end of inner mandrel 396 is connected to a valve body 442 at threaded connection 444. A sealing means, such as 0-ring 446, provides sealing engagement between valve body 442 and inner mandrel 396.

Valve body 442 defines a tapered annular seat 448 therein with a generally transverse aperture 450 adjacent thereto.

A poppet type valve 452 with an annular seal 454 thereon is pivotally attached to valve body 442 by pivot pin 456. A torsion spring 458 biases valve 452 toward a closed position in which seal 454 sealingly engages seat 448 in valve body 442. As shown in FIG. 5B, valve 452 is in an open position.

Referring again to FIG. 5A, stinger sleeve 390 has an outside diameter 460 adapted for closely fitting within bore 401 in inner mandrel 396 of lower packer portion 24'. A sealing means, such as a plurality of seals 462, provide sealing engagement between stinger sleeve 390 and bore 401.

The lower end of stinger sleeve 390 is connected to a stinger mandrel 464 at threaded connection 466. When stinger 28' is inserted into lower packer portion 24', stinger mandrel 464 pushes valve 452 to its pivoted, open position.

Operation Of The Alternate Embodiment

Lower packer portion 24' is set on a wireline in a manner similar to lower packer portion 24 of the first described embodiment. That is, shear pins 404, 416 and 432 are sheared. Lower slip wedge 430 is moved downwardly to force lower slips 434 into gripping engagement with casing bore 16, thereby breaking band 436. Packer elements 422, 424 and 426 are squeezed into sealing engagement with casing bore 16, and upper slip support 402 is moved downwardly so that upper slips 410 are moved outwardly into gripping engagement with the casing bore, thereby breaking band 412. Upper packer portion 24 with stinger 28' attached thereto is lowered into the wellbore, and the stinger is inserted into lower packer portion 24' so that stinger mandrel 464 opens valve 452 as previously described. The cementing of lower perforations 18 is carried out by pumping cement through central opening 29 and lower packer portion 24'.

The remainder of the operation of the alternate embodiment is identical to that of the first describe embodiment.

It will be seen, therefore, that the method and apparatus for performing a block squeeze cementing job of the present invention are well adapted to carry out the ends and advantages mentioned, as well as those inherent therein. While two presently preferred embodiments of the apparatus and corresponding methods are described for the purposes of this disclosure, numerous changes in the arrangement and construction of parts in the apparatus and steps in the methods may be made by those skilled in the art. All such changes are encompassed within the scope and spirit of the appended claims.

What is claimed is:

1. A method of block squeeze cementing a well formation comprising the steps of:
   - perforating a wellbore above and below the well formation on a single wireline trip;
   - setting a lower packer on a wireline above lower perforations formed by said step of perforating;
   - positioning a stinger in said lower packer;
   - setting an upper packer above upper perforations formed by said step of perforating;
   - cementing said lower perforations through said lower packer;
   - unsetting said upper packer;
   - repositioning said stinger adjacent to said upper perforations;
   - setting said upper packer above said upper perforations; and
   - cementing said upper perforations through said upper packer and stinger.

2. The method of claim 1 wherein:
   - the first mentioned step of setting said upper packer comprises setting secondary packer elements; and
   - the last mentioned step of setting said upper packer comprises setting primary packer elements.

3. The method of claim 2 wherein said secondary packer elements are set with only vertical movement.

4. The method of claim 1 further comprising the step of locking said upper packer against vertical movement while cementing said lower perforations.

5. The method of claim 1 wherein said stinger opens a valve in said lower packer when inserted therein.

6. The method of claim 1 wherein the first and last mentioned steps of setting said upper packer and said steps of cementing said lower and upper perforations are carried out on a single tubing trip.

7. A wellbore packer for use in block squeeze cementing a well formation, said packer comprising:
   - case means for connecting to a tubing string;
   - mandrel means disposed in said case means for extending downwardly therefrom;
   - primary packing means on said mandrel means for sealingly engaging the wellbore when in a set position; and
   - secondary packing means on said mandrel means for sealingly engaging said wellbore when in a set position;
   - wherein:
     - said secondary packing means is individually setable only with vertical movement of said tubing string without setting of said primary packing means; and
     - said primary packing means is individually setable with vertical and rotational movement of said tubing string without setting of said secondary packing means.

8. The packer of claim 7 wherein said secondary packing means requires less vertical movement of said tubing string for setting than does said primary packing means.

9. The packer of claim 7 wherein said secondary packing means is disposed below said primary packing means.

10. The packer of claim 7 wherein said primary and secondary packing means are individually setable on a single trip of said tubing string into said wellbore.

11. An apparatus for use in a wellbore for block squeeze cementing a well formation, said apparatus comprising:
   - an upper packer portion connectable to a tubing string and comprising primary packer elements and secondary packer elements individually setable into sealing engagement with the wellbore;
   - a stinger extending downwardly from said upper packer portion and in communication therewith; and
   - a lower packer portion adapted for receiving said stinger therein.

12. The apparatus of claim 11 wherein:
   - said lower packer portion comprises a valve therein; and
   - said stinger is adapted for opening said valve in said lower packer portion.

13. The apparatus of claim 12 wherein:
   - said valve is a sliding valve having a collet extending therefrom; and
   - said stinger is adapted for engaging said collet for opening and closing said valve.

14. The apparatus of claim 12 wherein:
   - said valve is a poppet type valve; and
   - said stinger is adapted for pivoting said valve to an open position when inserted into said lower packer portion.

15. The apparatus of claim 11 wherein said secondary packer elements may be placed into engagement with said wellbore with only vertical movement.

16. The apparatus of claim 11 wherein said secondary packer elements are set by less vertical movement than required for setting said primary packer elements.

17. The apparatus of claim 11 wherein said secondary elements are unset by lifting on the tubing string.

18. The apparatus of claim 11 wherein said upper packer portion further comprises hydraulic slips which may be actuated by pressure below said secondary packer elements when said secondary packer elements are set.

19. The apparatus of claim 11 wherein said upper packer portion defines a bypass passageway therein for equalizing pressure above and below said secondary packer elements.

* * * * *